US007864146B2

(12) United States Patent
Liu

(10) Patent No.: US 7,864,146 B2
(45) Date of Patent: Jan. 4, 2011

(54) GAMMA VOLTAGE OUTPUT CIRCUIT HAVING THE SAME DC CURRENT VOLTAGE INPUT FOR LIQUID CRYSTAL DISPLAY

(75) Inventor: Ming-Jie Liu, Shenzhen (CN)

(73) Assignees: Innocom Technology (Shezhen) Co., Ltd., Shenzhen, Guangdong Province (CN); Chimei Innolux Corporation, Miao-Li (TW)

( * ) Notice: Subject to any disclaimer, the term of this patent is extended or adjusted under 35 U.S.C. 154(b) by 802 days.

(21) Appl. No.: 11/880,576

(22) Filed: Jul. 23, 2007

(65) Prior Publication Data

US 2008/0049001 A1 Feb. 28, 2008

(30) Foreign Application Priority Data

Jul. 21, 2006 (TW) ..... 95126671 A

(51) Int. Cl.
*G09G 3/36* (2006.01)

(52) U.S. Cl. ..... 345/89

(58) Field of Classification Search ..... 345/87, 345/95, 204, 88, 89, 690
See application file for complete search history.

(56) References Cited

U.S. PATENT DOCUMENTS 6,211,866 B1 * 4/2001 Okutani ..... 345/209
6,836,232 B2 12/2004 Bu
7,388,592 B2 * 6/2008 Chuang et al. ..... 345/204
2001/0004255 A1 6/2001 Nishimura
2007/0040855 A1 * 2/2007 Kato ..... 345/690

* cited by examiner

*Primary Examiner*—Chanh Nguyen
*Assistant Examiner*—Jonathan Blancha
(74) *Attorney, Agent, or Firm*—Wei Te Chung

(57) ABSTRACT

An exemplary gamma voltage output circuit (2) for a liquid crystal display includes a plurality of operational amplifiers (221) and a plurality of resistors (Rn1~Rn2). Each of the operational amplifiers includes a high voltage input port, a low voltage input port, a non-inverting input port, an inverting input port, and an output port. The high voltage input port of each operational amplifier connects to a same electrical source, and the low voltage input port of each operational amplifier is grounded. The non-inverting input port of each operational amplifier receives a same direct-current voltage, and the output port of each operational amplifier outputs a gamma voltage configured for driving the liquid crystal display and is grounded via two respective of the resistors connected in series. A node between the two respective resistors connects to the inverting input port of the operational amplifier.

11 Claims, 4 Drawing Sheets

GAMMA VOLTAGE OUTPUT CIRCUIT HAVING THE SAME DC CURRENT VOLTAGE INPUT FOR LIQUID CRYSTAL DISPLAY

FIELD OF THE INVENTION

The present invention relates to voltage output circuits, and more particularly to a gamma voltage output circuit for driving a liquid crystal display (LCD).

BACKGROUND

LCDs are commonly used as display devices for compact electronic apparatuses, because they not only provide good quality images with little power but also are very thin. In general, an LCD includes a liquid crystal panel and a backlight module for illuminating the liquid crystal panel.

The LCD panel needs to be driven by gamma voltages in order to display images. The gamma voltages are provided from an external apparatus. Each gray scale of the images displayed by the LCD panel corresponds to a gamma voltage signal. Referring to FIG. 3, a conventional gamma voltage output circuit is shown. The gamma voltage output circuit 1 is capable of outputting gamma voltage signals to display gray scale images with fourteen levels. That is, the gamma voltage output circuit 1 can output fourteen gamma voltages V1~V14.

The gamma voltage output circuit 1 includes: a resistor string 11 connected between an analog electrical source (AVDD) and ground; and fourteen operational amplifiers 12. The resistor string 11 includes fifteen resistors R0~R14 connected in series. Each of nodes respectively between two corresponding adjacent resistors is grounded via a capacitor. A node between the analog electrical source and the resistor R0 is also grounded via a capacitor. A non-inverting input port of each operational amplifier 12 connects to a corresponding node between two adjacent resistors, and an inverting input port of each operational amplifier 12 connects to an output port of the same corresponding operational amplifier 12. A high voltage input port of each operational amplifier 12 connects to the analog electrical source, and a low voltage input port of each operational amplifier 12 grounds. The output port of each operational amplifier 12 outputs a gamma voltage.

In the gamma voltage output circuit 1, the voltage output from the analog electrical source is distributed to the resistors R0~R14 of the resistor string 11, and the capacitors have a function of wave filtering. Each operational amplifier 12 improves the capability of equipping loads. The gamma voltage output from the output port of each operational amplifier 12 is equal to the voltage signal inputted into the non-inverting input port of the same operational amplifier 12. Thus, each gamma voltage can be calculated according to the following equations:

$$V1=AVDD*(R1+R2+\ldots+R14)/(R0+R1+R2+\ldots+R14)$$

$$V2=AVDD*(R2+\ldots+R14)/(R0+R1+R2+\ldots+R14)$$

$$\ldots$$

$$V14=AVDD*R14/(R0+R1+R2+\ldots+R14)$$

In order to increase the precision of the resistors R0~R14, the configuration of the resistor string 11 can usually be varied. Referring to FIG. 4, the resistors R01 and R02 are connected in parallel, and a resistance of the parallel connected resistors R01 and R02 is equal to that of the resistor R0. The resistors R11 and R12 are connected in parallel, and a resistance of the parallel connected resistors R11 and R12 is equal to that of the resistor R1. In other words, each pair of resistors Rm1 and Rm2 are connected in parallel, and a resistance of the parallel connected resistors Rm1 and Rm2 is equal to that of the resistor Rm ($0 \leqq m \leqq 14$). Thus the resistance of the resistors R0~R14 can be suitably configured by controlling the resistances of the resistors Rm1~Rm2.

When the gamma voltages need to be modulated, the resistances of the corresponding resistors need to be adjusted. For example, when the gamma voltage V2 needs to be modulated, then the resistance of the resistors R2 (R21 and R22) needs to be adjusted. However, according to the equations shown above, when the resistance of one of the resistors is varied, the value of other output gamma voltages also varies. That is, the gamma voltages output from the gamma voltage output circuit 1 affect one another, and cannot be adjusted individually.

Accordingly, what is needed is a gamma voltage output circuit that can overcome the above-described deficiencies.

SUMMARY

An exemplary gamma voltage output circuit for a liquid crystal display includes a plurality of operational amplifiers and a plurality of resistors. Each of the operational amplifiers includes a high voltage input port, a low voltage input port, a non-inverting input port, an inverting input port, and an output port. The high voltage input port of each operational amplifier connects to a same electrical source, and the low voltage input port of each operational amplifier is grounded. The non-inverting input port of each operational amplifier receives a same direct-current voltage, and the output port of each operational amplifier outputs a gamma voltage configured for driving the liquid crystal display and is grounded via two respective of the resistors connected in series. A node between the two respective resistors connects to the inverting input port of the operational amplifier.

Other novel features and advantages will become apparent from the following detailed description of preferred and exemplary embodiments when taken in conjunction with the accompanying drawings.

DETAILED DESCRIPTION OF PREFERRED EMBODIMENTS

Reference will now be made to the drawings to describe preferred and exemplary embodiments in detail.

Figure 1:
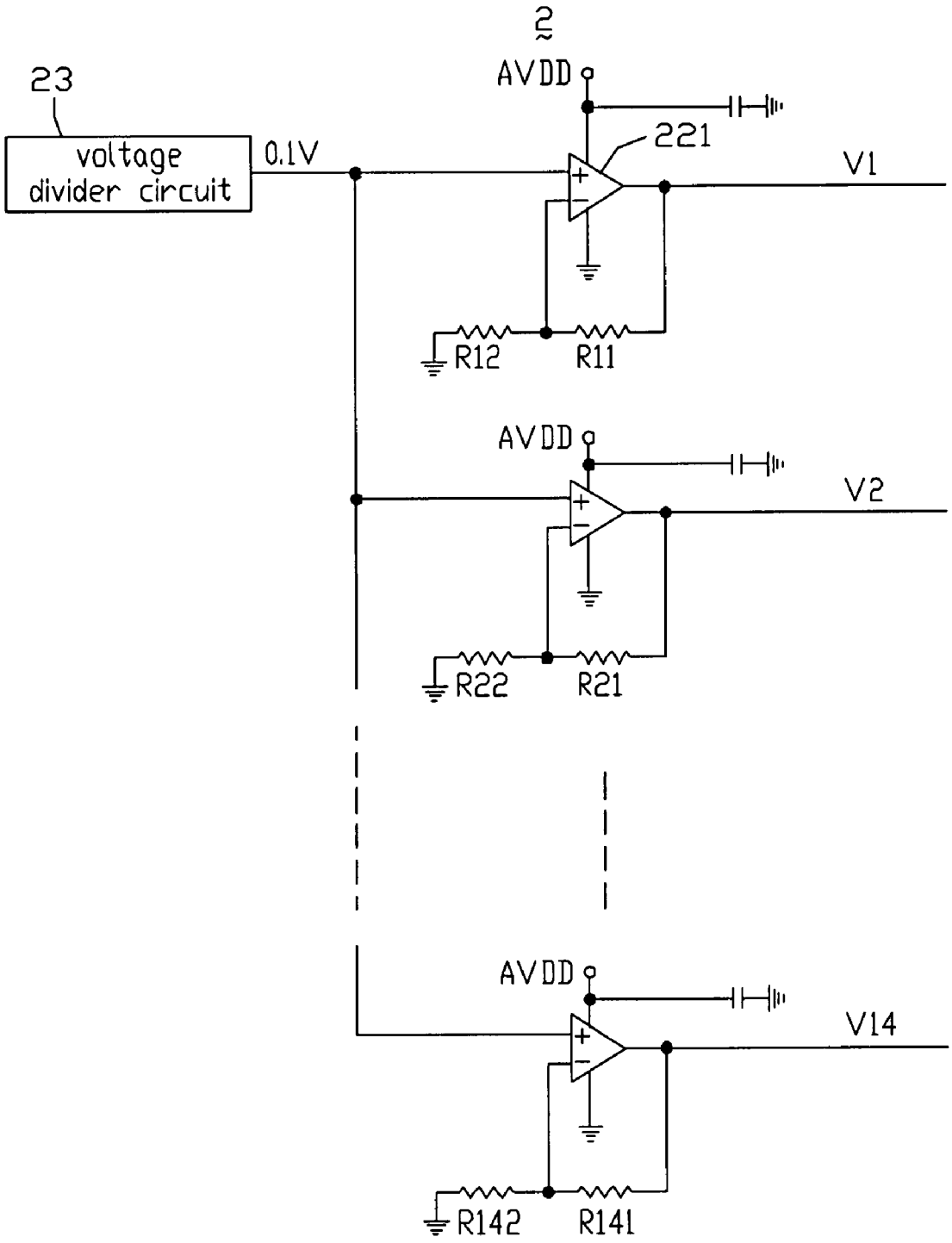
FIG. 1 is an abbreviated diagram of a gamma voltage output circuit according to an exemplary embodiment of the present invention.

Referring to FIG. 1, this is a circuit diagram of a gamma voltage output circuit according to an exemplary embodiment of the present invention. The gamma voltage output circuit 2 outputs gamma voltages to drive an LCD panel (not shown) to display images. In this exemplary embodiment, the gamma voltage output circuit 2 is capable of outputting gamma voltages to drive the LCD panel to display images having a gray scale with fourteen levels. That is, the gamma voltage output circuit 2 can output fourteen gamma voltages V1~V14. The gamma voltage output circuit 2 includes a voltage divider circuit 23, fourteen operational amplifiers 221, and twenty-eight resistors R11, R12, R21, R22, . . . , Rn1 and Rn2 (0≦n≦14).

A high voltage input port of each operational amplifier 221 connects to an analog electrical source (AVDD) and is grounded via a capacitor. A low voltage input port of each operational amplifier 221 is grounded. A non-inverting input port of each operational amplifier 221 receives a direct-current (DC) voltage provided by the voltage divider circuit 23, such as 0.1 volts in this embodiment. An output port of each operational amplifier 221 outputs a gamma voltage, and is grounded via two corresponding resistors Rn1 and Rn2 (0≦n≦14) connected in series. A node between the two resistors Rn1 and Rn2 connects to an inverting input port of the corresponding operational amplifier 221.

In the gamma voltage output circuit 2, the capacitors have a function of wave filtering. The gamma voltages V1~V14 output from the operational amplifiers 221 are in the range from 0.1 to (AVDD-0.1) volts. The gamma voltages V1~V14 can be modulated via adjusting the resistance of the resistors R11, R12, R21, R22 . . . Rn1 and Rn2 (0≦n≦14), and each gamma voltage can be calculated according to the following equations:

$$V1=0.1*(1+R11/R12)$$

$$V2=0.1*(1+R21/R22)$$

. . .

$$Vn=0.1*(1+Rn1/Rn2),\ (1\leqq n\leqq 14)$$

Figure 2:
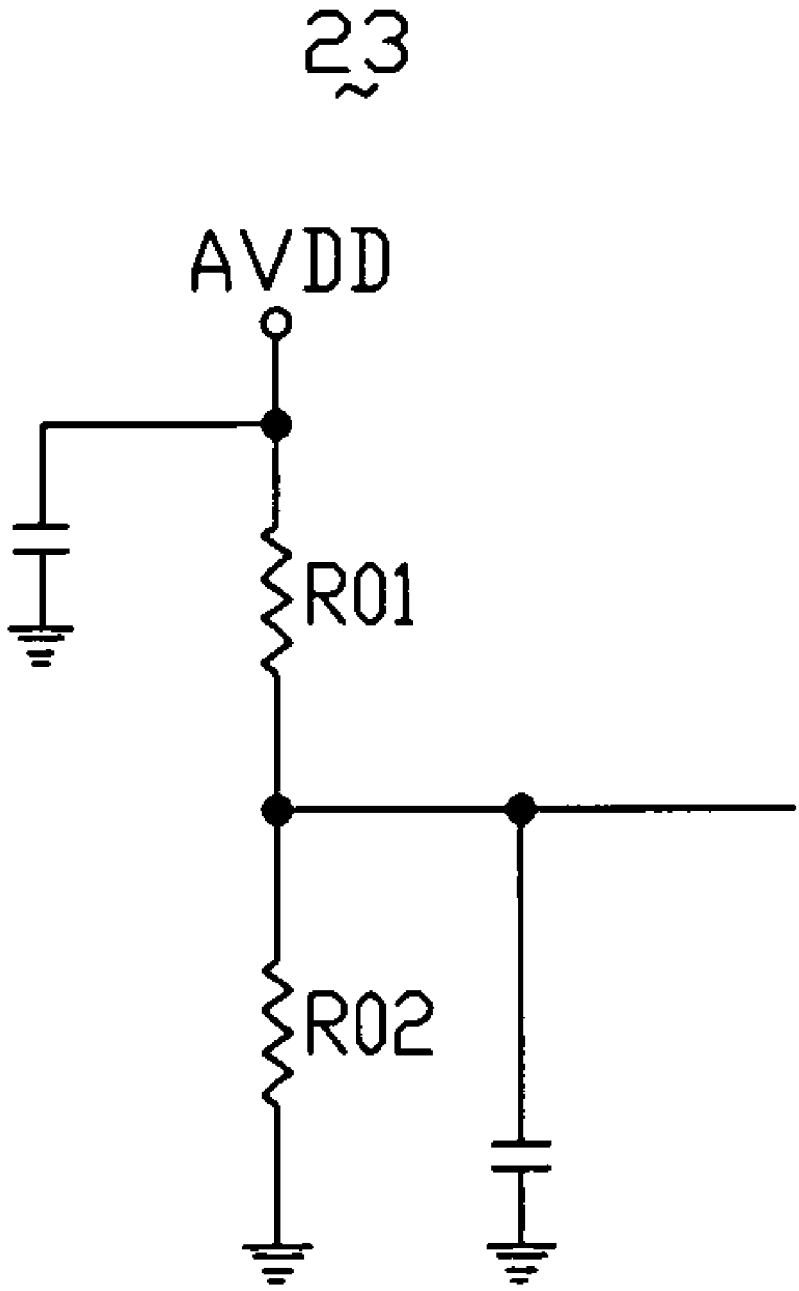
FIG. 2 is a diagram of a voltage divider circuit of the gamma voltage output circuit of FIG. 1.
Figure 3:
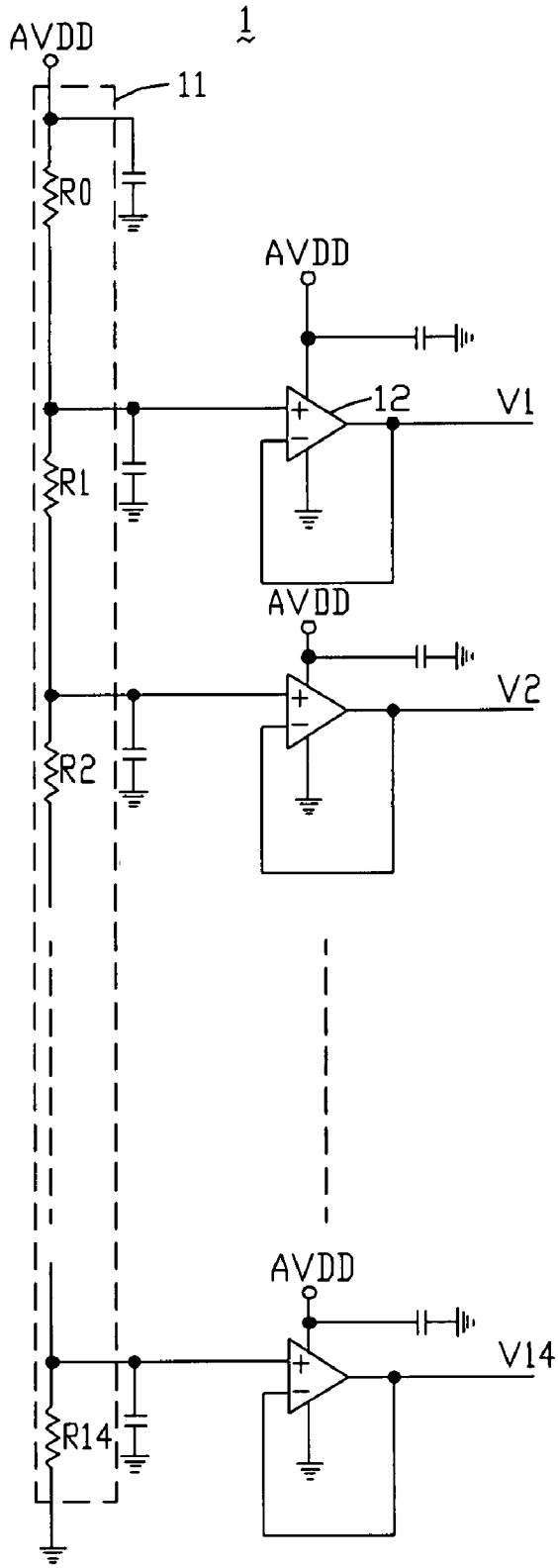
FIG. 3 (RELATED ART)
FIG. 3 is an abbreviated diagram of a conventional gamma voltage output circuit, the gamma voltage output circuit including a resistor string.
Figure 4:
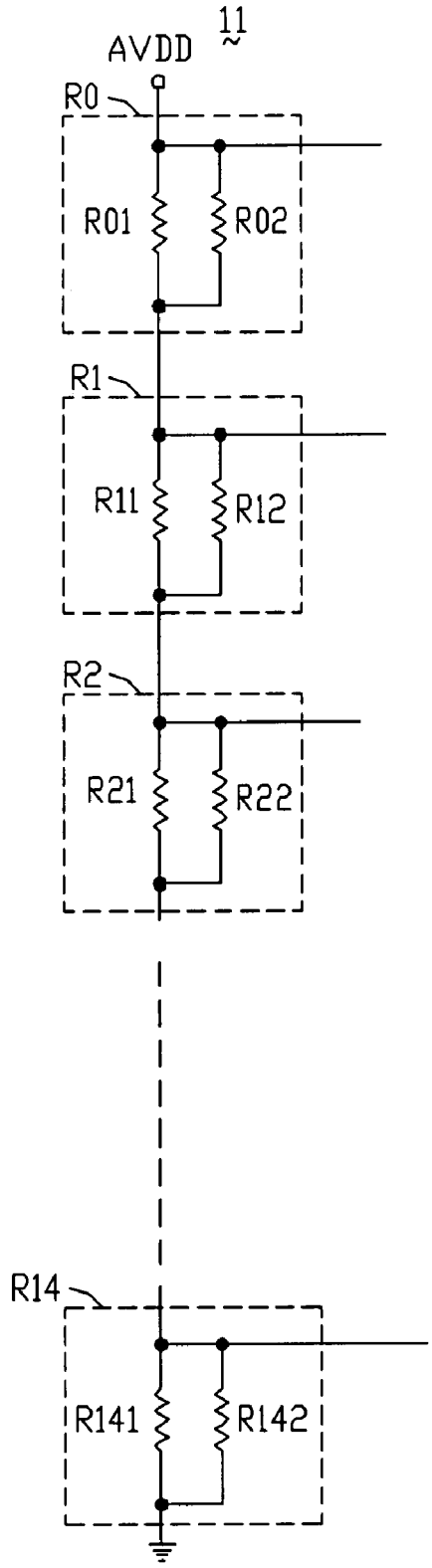
FIG. 4 (RELATED ART)
FIG. 4 is a diagram corresponding to part of the gamma voltage output circuit of FIG. 3, showing an alternative configuration of the resistor string thereof.

Referring to FIG. 2, a diagram of the voltage divider circuit 23 is shown. The voltage divider circuit 23 includes two resistors R01 and R02 connected in series between the analog electrical source (AVDD) and ground. A node between the resistors R01 and R02 is considered as an output port of the voltage divider circuit 23, and is grounded via a capacitor. A node between the analog electrical source and the resistor R01 is grounded via another capacitor. These two capacitors have a function of wave filtering. The voltage output from the voltage divider circuit 23 can be modulated by adjusting the resistances of the resistors R01 and R02.

Unlike with the above-described conventional gamma voltage output circuit 1, the operational amplifiers 221 in the gamma voltage output circuit 2 can be adjusted individually and do not influence each other. Moreover, each gamma voltage only relates to two resistors Rn1 and Rn2 (0≦n≦14) connected to the output port of corresponding operational amplifier 221, which ensures that it is convenient to calculate and adjust the gamma voltage.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A gamma voltage output circuit for a liquid crystal display, the gamma voltage output circuit comprising:

a plurality of operational amplifiers, each of the operational amplifiers comprising a high voltage input port, a low voltage input port, a non-inverting input port, an inverting input port, and an output port; and a plurality of resistors;

wherein the high voltage input port of each operational amplifier connects to a same electrical source, the low voltage input port of each operational amplifier is grounded, the non-inverting input port of each operational amplifier receives a same direct-current voltage, the output port of each operational amplifier outputs a gamma voltage configured for driving the liquid crystal display and is grounded via two respective of the resistors connected in series, and a node between the two respective resistors connects to the inverting input port of the operational amplifier.

2. The gamma voltage output circuit as claimed in claim 1, wherein the high voltage input port of each operational amplifier is grounded via a capacitor.

3. The gamma voltage output circuit as claimed in claim 1, wherein the gamma voltage output circuit comprises fourteen of the operational amplifiers and twenty-eight of the resistors.

4. The gamma voltage output circuit as claimed in claim 1, further comprising a voltage divider circuit, wherein the direct-current voltage is provided by the voltage divider circuit.

5. The gamma voltage output circuit as claimed in claim 4, wherein the voltage divider circuit outputs a voltage of approximately 0.1 volts.

6. The gamma voltage output circuit as claimed in claim 4, wherein the voltage divider circuit comprises two resistors connected in series between an electrical source and ground, and a node between the two resistors of the voltage divider circuit is an output port of the voltage divider circuit.

7. The gamma voltage output circuit as claimed in claim 6, wherein the node between the two resistors of the voltage divider circuit is grounded via a capacitor, and the electrical source is grounded via a capacitor.

8. The gamma voltage output circuit as claimed in claim 1, wherein the electrical source is an analog electrical source.

9. A gamma voltage output circuit for a liquid crystal display, the gamma voltage output circuit comprising:

a plurality of operational amplifiers, each of the operational amplifiers comprising a high voltage input port, a low voltage input port, a non-inverting input port, an inverting input port, and an output port; and wherein the high voltage input ports of said operational amplifier share, in parallel, with one another a same electrical source which is operated with a common resistor assembly, the low voltage input port of each operational amplifier is grounded, the non-inverting input port of each operational amplifier receives a same direct-current voltage, the output port of each operational amplifier outputs a gamma voltage configured for driving the liquid crystal display and is grounded via a specific resistor assembly which is different from other resistor assemblies used with other amplifiers, and said specific resistor assembly connects to the inverting input port of the corresponding operational amplifier.

10. The gamma voltage output circuit as claimed in claim 9, wherein the common resistor assembly includes two respective resistors, and an output port of said same electrical source connects to a node between said two respective resistors.

11. The gamma voltage output circuit as claimed in claim 9, wherein said specific resistor assembly includes at least two respective resistors with a node therebetween connecting to the inverting input port the corresponding operational amplifier.

* * * * *